US007475777B2

(12) United States Patent
Fung et al.

(10) Patent No.: US 7,475,777 B2
(45) Date of Patent: Jan. 13, 2009

(54) CARTON WITH ARTICLE RETAINING FEATURE

(75) Inventors: Charles F. Ho Fung, Dunwoody, GA (US); Andrea Coltri-Johnson, Acworth, GA (US); Jean-Manuel Gomes, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 268 days.

(21) Appl. No.: 11/443,984

(22) Filed: May 31, 2006

(65) Prior Publication Data

US 2007/0278120 A1 Dec. 6, 2007

(51) Int. Cl.
*B65D 5/72* (2006.01)

(52) U.S. Cl. ..... 206/427; 229/122.1; 229/221

(58) Field of Classification Search ..... 206/427, 206/429; 229/122, 122.1, 221, 242
See application file for complete search history.

(56) References Cited

U.S. PATENT DOCUMENTS

| | | | | |
|---|---|---|---|---|
| 2,299,027 | A | 10/1942 | Novak | |
| 3,265,283 | A | 8/1966 | Farquhar | |
| 4,364,509 | A * | 12/1982 | Holley et al. | 221/305 |
| 4,396,143 | A | 8/1983 | Killy | |
| 4,805,765 | A | 2/1989 | Barrett et al. | |
| 4,987,996 | A * | 1/1991 | Anderson | 206/321 |
| 5,860,517 | A * | 1/1999 | Gemma et al. | 206/63.3 |
| 6,959,857 | B2 * | 11/2005 | Bates | 229/122.1 |
| 7,066,380 | B2 * | 6/2006 | Blake | 229/122.1 |
| 7,147,143 | B2 * | 12/2006 | Cargile | 229/122 |
| 7,207,474 | B2 * | 4/2007 | Holley, Jr. | 229/242 |
| 7,357,254 | B2 * | 4/2008 | Auclair et al. | 206/427 |
| 2003/0098344 | A1 * | 5/2003 | Blake | 229/122.1 |
| 2004/0159671 | A1 | 8/2004 | Spivey | |

* cited by examiner

*Primary Examiner*—Jacob K Ackun, Jr.
(74) *Attorney, Agent, or Firm*—Womble Carlyle Sandridge & Rice, PLLC

(57) ABSTRACT

A carton includes a retaining structure that is arranged to retain articles within the carton when an end of the carton has been opened. The retaining structure includes an obstruction spaced from the opened end of the carton that abuts an article located at a dispenser opening of the carton.

23 Claims, 10 Drawing Sheets

CARTON WITH ARTICLE RETAINING FEATURE

BACKGROUND

Cartons with gravity-feed dispensing features are known. A gravity-feed dispensing feature is typically located at a low point on the carton so that containers held within the carton advance toward the dispenser opening under the action of gravity. Gravity-feed dispensing features typically rely on friction between the dispenser opening and the containers held within the carton to retain the containers and prevent them from inadvertently exiting the carton under the force of gravity. Conventional gravity-feed dispensers, however, may not be robust enough to retain certain heavy containers. Movement of the carton or shifting of the containers within the carton may also cause containers to overcome the retaining force of the dispenser and inadvertently exit the carton.

SUMMARY

According to a first embodiment of the present invention, a carton comprises a first side panel, a top panel, a second side panel, a bottom panel, a first end panel, a second end panel, and a retaining structure defined at least in the first end panel. The retaining structure comprises a plurality of panels that, when the carton is opened at its first end and the retaining structure is placed in a retaining configuration, define an obstruction that prevents containers from inadvertently exiting through a dispenser opening the carton.

According to one exemplary aspect of the first embodiment, containers may be fed to the dispenser opening by the action of gravity. A container at the dispenser opening abuts the obstruction so that the containers are securely retained at the dispenser opening. The containers are therefore unlikely to fully escape from the carton due to movement of the carton or due to shifting of the carton contents. The dispenser opening may be formed simultaneously with placing the retaining structure in its retaining configuration, and the retaining structure may be formed from the first end panel and the side panels of the carton so that it does not utilize additional board area.

According to another exemplary aspect of the first embodiment, the obstruction may be spaced from the first end panel so that a significant portion of the container at the dispenser opening extends through the dispenser opening. The container at the dispenser opening is therefore easily grasped and pulled from the carton.

According to yet another exemplary aspect of the invention, a second dispenser may be defined in a second end of the carton. When the second end of the carton is opened, the second dispenser opening can be used to withdraw containers from the carton and/or to assist in advancing containers toward the dispenser opening in the first end of the carton.

Other aspects, features, and details of embodiments of the present invention can be more completely understood by reference to the following detailed description of preferred embodiments, taken in conjunction with the drawings figures and from the appended claims.

BRIEF DESCRIPTION OF THE DRAWING FIGURES

According to common practice, the various features of the drawings are not necessarily drawn to scale. Dimensions of various features and elements in the drawings may be expanded or reduced to more clearly illustrate the embodiments of the invention.

DETAILED DESCRIPTION

The first embodiment of the present invention generally relates to a carton suitable for storing and dispensing articles such as, for example, containers containing beverages, foodstuffs and other products. The carton includes a retaining structure that prevents articles from inadvertently rolling out of the carton when the carton is in a dispensing configuration.

Articles accommodated within the present carton embodiments can include containers such as, for example, petaloid bottle containers, beverage cans, cans containing foodstuffs, glass or plastic bottles, etc. For the purposes of illustration and not for the purpose of limiting the scope of the invention, the following detailed description describes generally cylindrical metallic containers as disposed within the carton. In this specification, the terms "side," "end," "bottom," "lower," "upper" and "top" indicate orientations determined in relation to a fully erected carton placed in a dispensing orientation.

Figure 1:
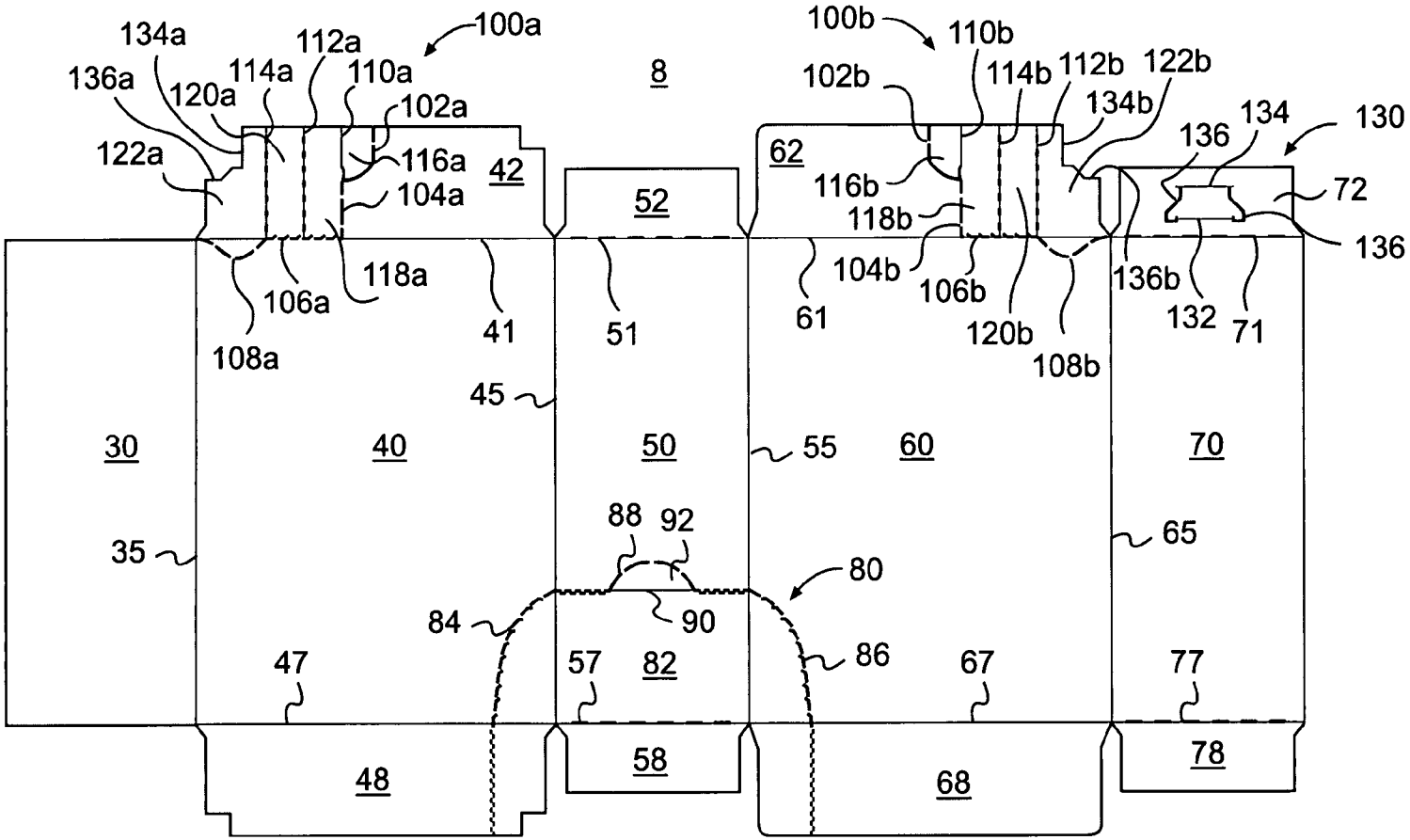
FIG. 1 is a plan view of a blank used to form a carton having a retaining structure according to a first embodiment of the present invention.

FIG. 1 is a plan view of a blank 8 used to form a carton 190 (illustrated in FIGS. 3-5) according to a first embodiment of the present invention. The exterior or print side of the blank 8 is illustrated in FIG. 1. The blank 8 comprises a first or inner bottom panel 30 foldably connected to a first side panel 40 at a transverse fold line 35, a top panel 50 foldably connected to the first side panel 40 at a transverse fold line 45, a second side panel 60 foldably connected to the top panel 50 at a transverse fold line 55, and a second or outer bottom panel 70 foldably connected to the second side panel 60 at a transverse fold line 65. The panels 30, 40, 50, 60, 70 of the blank 8 are rectangular in shape.

The first side panel 40 is foldably connected to a first side first end flap 42 along a longitudinal fold line 41 and a first side second end flap 48 along a longitudinal fold line 47. The top panel 50 is foldably connected to a first top end flap 52 along a longitudinal fold line 51 and a second top end flap 58 along a longitudinal fold line 57. The second side panel 60 is foldably connected to a second side first end flap 62 along a longitudinal fold line 61 and a second side second end flap 68 along a longitudinal fold line 67. The outer bottom panel 70 is foldably connected to a first bottom end flap 72 along a longitudinal fold line 71 and second bottom end flap 78 along a longitudinal fold line 77.

Figure 3:
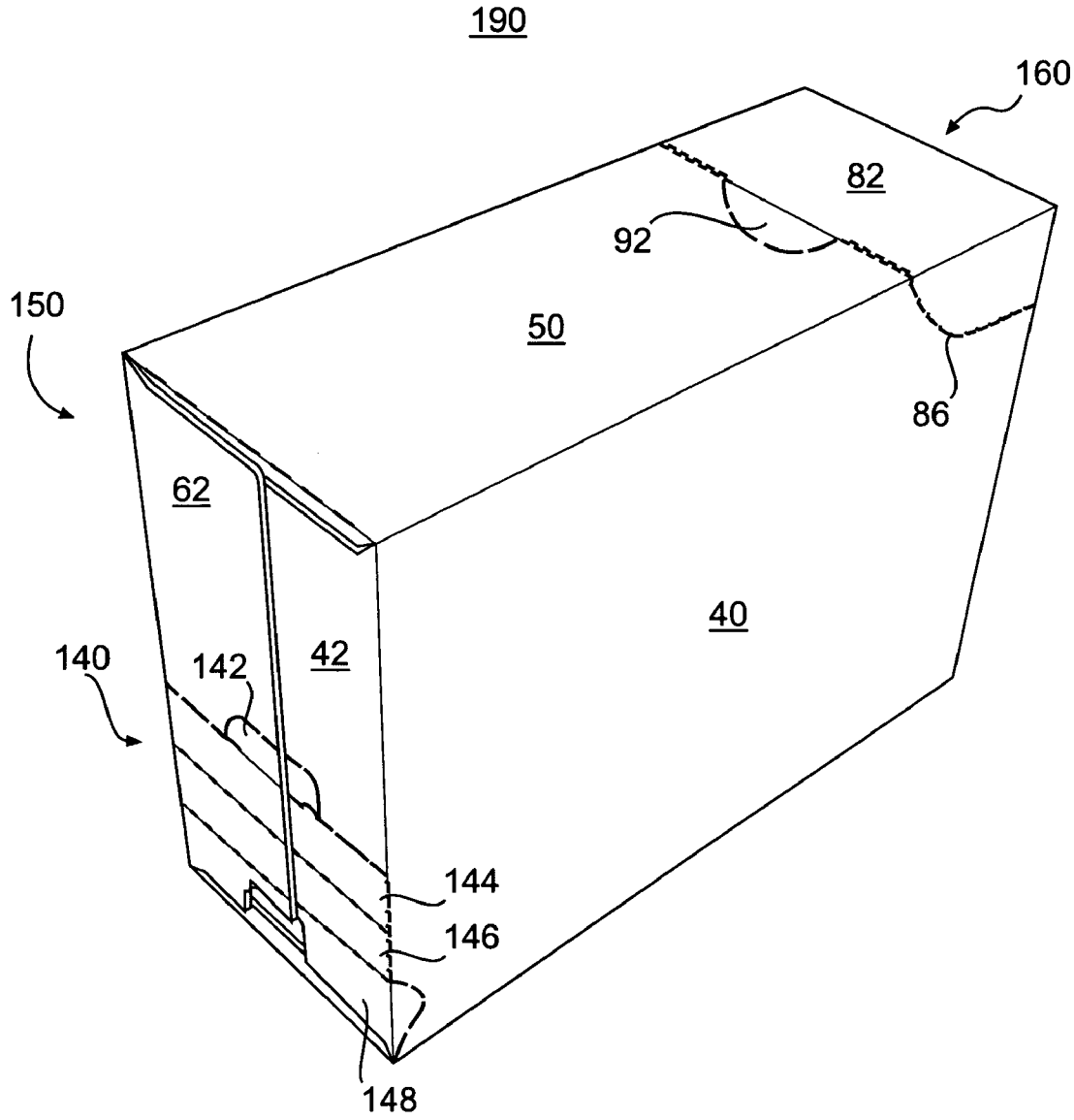
FIG. 3 is a perspective view of the carton erected from the blank of FIG. 1.
Figure 4:
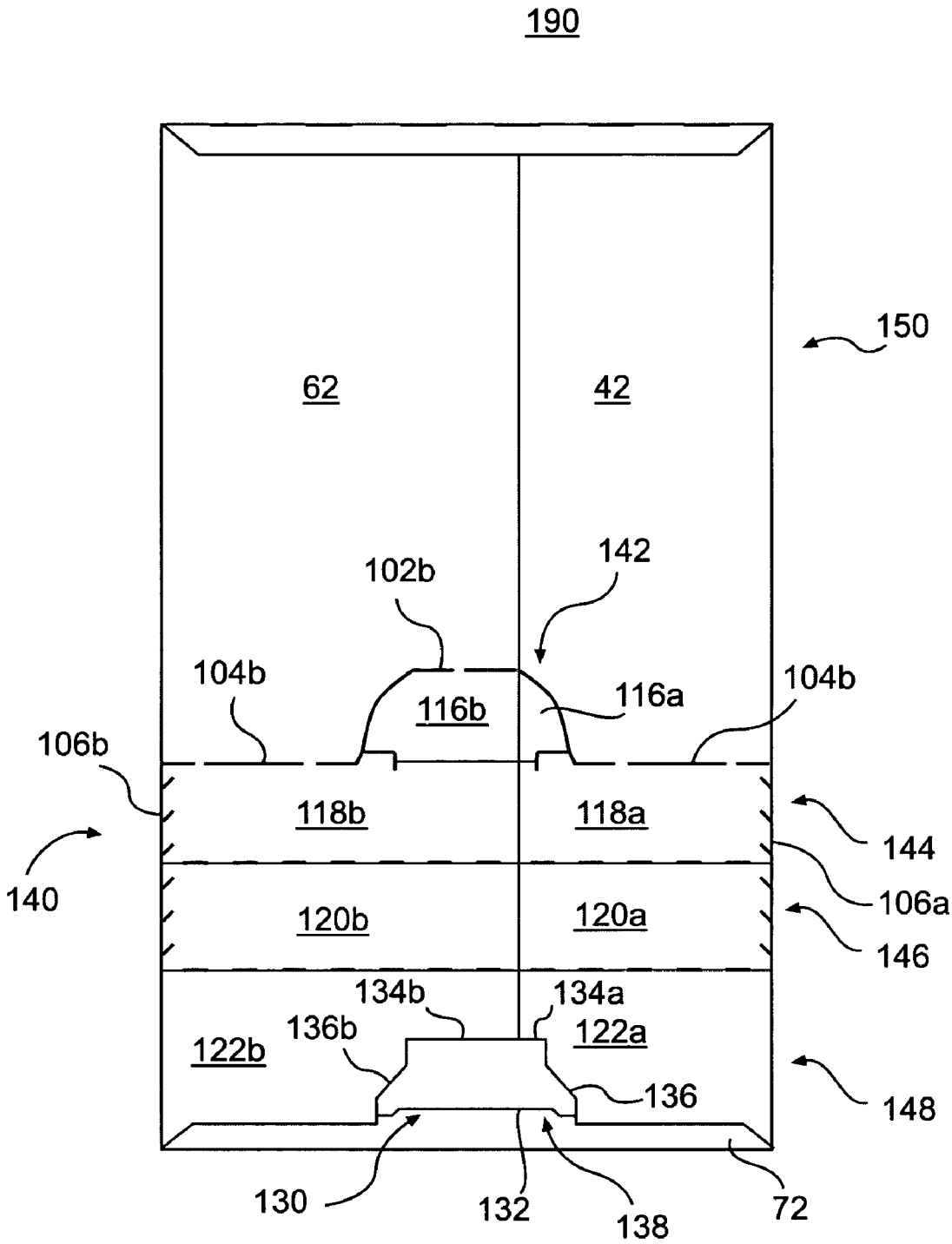
FIG. 4 illustrates a first end of the carton.
Figure 5:
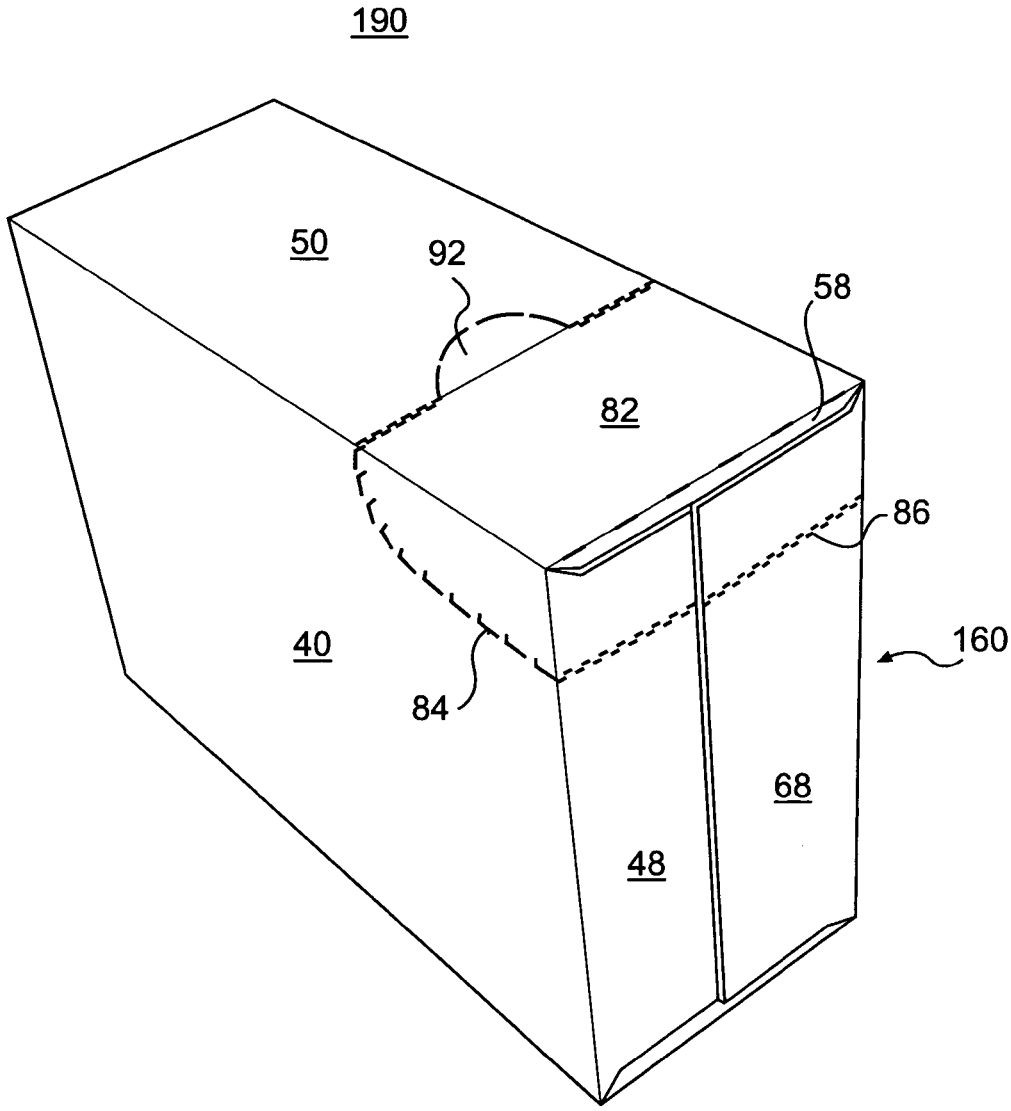
FIG. 5 is a perspective view of the second end of the carton.

The first end flaps 42, 52, 62, 72 extend along a first marginal area of the blank 8, and close a first end of the carton 190 (illustrated in FIGS. 3-5). The second end flaps 48, 58, 68, 78 extend along a second marginal area of the blank 8, and close a second end of the carton 190. The longitudinal fold lines 41, 51, 61, 71 may be collinear, straight fold lines, or, one or more of the lines 41, 51, 61, 71 may be offset at one or more locations to account for, for example, blank thickness.

The longitudinal fold lines 47, 57, 67, 77 may be also collinear or one or more of the lines may be offset at one or more locations.

According to one exemplary aspect of the invention, first and second side retaining patterns 100*a*, 100*b*, and a bottom retaining pattern 130 are formed along the first marginal area of the blank 8. The retaining patterns 100*a*, 100*b*, 130 define a retaining structure 140 in the erected carton 190 (illustrated in FIGS. 3-5).

The first and second side retaining patterns 100*a*, 100*b* are similar in construction and arrangement, and are arranged to align with one another in the erected carton 190. The perimeter of the first retaining pattern 100*a* is defined by a line of disruption 102*a* at a top edge of the retaining pattern 100*a*, a transverse line of disruption 104*a* extending from the line 102*a* to the longitudinal fold line 41, a longitudinal line of disruption 106*a* extending along the fold line 41, and a curved line of disruption 108*a* extending from the end of the line 106*a* to the transverse fold line 35. The transverse fold lines 110*a*, 112*a*, 114*a* may be parallel to one another, and define a first locking projection section 116*a*, a first inner stop panel section 118*a*, a first outer stop panel section 120*a*, and a first bottom stop panel section 122*a*.

The perimeter of the second retaining pattern 100*b* is defined by a line of disruption 102*b* at a top edge of the retaining pattern 100*b*, a transverse line of disruption 104*b* extending from the line 102*b* to the longitudinal fold line 61, a longitudinal line of disruption 106*b* extending along the fold line 61, and a curved line of disruption 108*b* extending from the end of the line 106*b* to the transverse fold line 65. Transverse fold lines 110*b*, 112*b*, 114*b* may be parallel to one another, and define a second locking projection section 116*b*, a second inner stop panel section 118*b*, a second outer stop panel section 120*b*, and a second bottom stop panel section 122*b*.

The bottom retaining pattern 130 can be, for example, a pattern of cut lines 132, 134, 136 defining an aperture in the first bottom end flap 72. The cuts 132, 134 may be longitudinal, parallel cuts, and the cuts 136 may include transverse, oblique and longitudinal sections. Alternatively, the perimeter of the retaining pattern 130 can comprise a pattern of breachable lines of disruption that define a knockout in the blank 8. The perimeter of the pattern 130 is arranged in the bottom end flap 72 to provide a friction lock to interact with the locking projection sections 116*a*, 116*b*. The end flap 42 includes bottom edges 134*a* and 136*a* that are similar in contour with and arranged to align with the lines 134, 136, respectively. Similarly, the end flap 62 includes bottom edges 134*b* and 136*b* that are similar in contour with and arranged to align with the lines 134, 136, respectively.

A second end dispenser pattern 80 may optionally be included at the opposite end of the blank 8. The dispenser pattern 80 defines a dispenser panel 82 that may be removed to open a second end of the carton 190 (illustrated in FIGS. 3-5). The dispenser pattern 80 comprises lines of disruption 84, 86 extending from edges of the blank 8 and into the top panel 50. An access panel or flap 92 is defined by a longitudinal fold line 90 and a curved line of disruption 88 and provides an entry point by which a user can initiate opening of the carton at the dispenser panel 82.

The fold lines 35, 45, 55, 65, 41, 47, 61, 67, 51, 57, 71, 77, 90, 110*a*, 112*a*, 114*a*, 110*b*, 112*b*, 114*b* formed in the blank 8 may be, for example, score lines, cut-space lines, cut-crease lines, combinations thereof, or other lines of disruption that facilitate folding of the blank 8. The periphery of the first and second side retaining patterns 100*a*, 100*b*, defined by the lines of disruption 102*a*, 104*a*, 106*a*, 108*a*, and 102*b*, 104*b*, 106*b*, 108*b*, respectively, and the periphery of the dispenser pattern 80 defined by the lines 84, 86, 88 may be generally characterized as "tear lines." One or more sections of the pattern perimeters may be, for example, replaced by cuts to facilitate separation of selected sections of the patterns in the carton 190 (illustrated in FIGS. 3-5).

An exemplary method of erection of the carton 190 will now be discussed with reference to FIGS. 1-3. Referring to FIG. 1, to construct the carton, glue or other adhesive may be applied to the interior side of the outer bottom panel 70 and/or to the exterior side of the inner bottom panel 30. The blank 8 is then folded about the transverse fold lines 45, 65 so that the interior side of the outer bottom panel 70 overlaps the exterior side of the inner bottom panel 30 and is adhered thereto. The partially erected blank 8 may then be opened up into the generally tubular sleeve form illustrated in FIG. 2.

Figure 2:
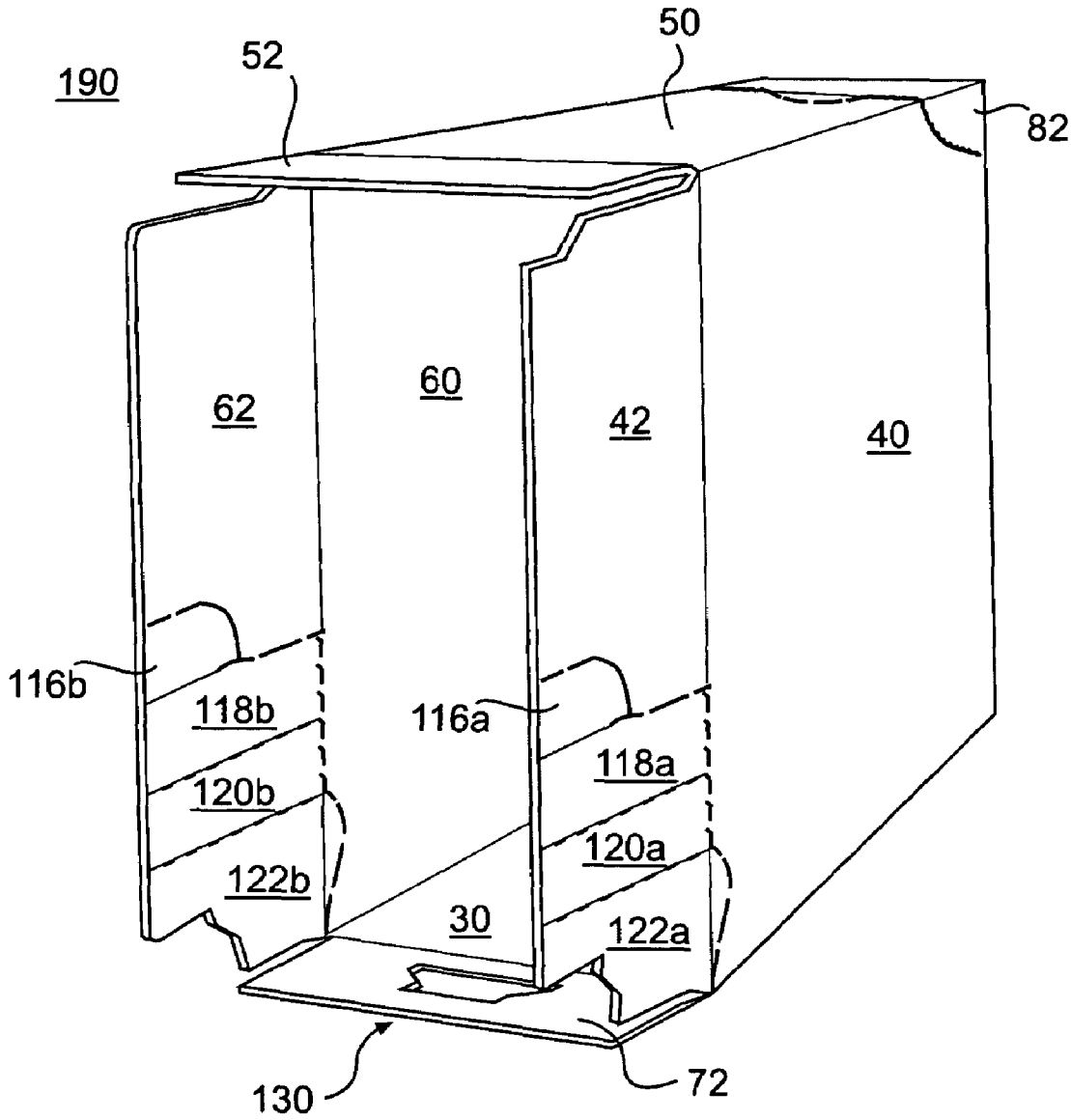
FIG. 2 illustrates the blank of FIG. 1 in a partially erected state.

Referring to FIGS. 1 and 2, the end flaps 58, 78 may be folded about the fold lines 57, 77, respectively, over the open second end of the carton (not shown in FIG. 2), and the side end flaps 48, 68 folded over the end flaps 58, 78. The interior sides of the side flaps 48, 68 may be adhered to the exterior sides of the end flaps 58, 78 to close the second end of the carton. Similarly, the interior sides of the side end flaps 42, 62 may be adhered to the exterior sides of the end flaps 52, 72 to close the first end of the carton. The second side first end flap 62 may, for example, overlap a portion of the first side first end flap 42 and may be adhered to the flap 42 at the overlapping portion. Articles such as, for example, generally cylindrical containers C may be loaded into the tubular sleeve in a conventional manner before one or both ends of the carton are closed by the end flaps. In the illustrated embodiment, the containers C (illustrated in FIG. 8) are arranged in a 3×4×1 configuration, although other arrangements are within the scope of the invention.

FIG. 3 illustrates the erected carton 190, which has a generally parallelepipedal shape, loaded with containers C (not shown in FIG. 3). Referring also to the end view of FIG. 4, in the erected carton 190, the overlapping end flaps 42, 52, 62, 72 at the first end of the carton 190 form a first end panel 150, and the end flaps 48, 58, 68, 78 at the second end of the carton form a second end panel 160 (illustrated in FIG. 5). In the first end panel, the first and second side retaining patterns 100*a*, 100*b* align with one another to define a retaining structure 140 at the first end of the carton 190. The retaining patterns 100*a*, 100*b* align to define the following elements of the retaining structure 140: a locking projection 142 formed from the sections 116*a*, 116*b*; an inner stop panel 144 formed from the sections 118*a*, 118*b*; an outer stop panel 146 formed from the sections 120*a*, 120*b*; and a bottom stop panel 148 formed from the sections 122*a*, 122*b*. As shown in FIG. 4, the second side first end flap 62 overlaps the first side first end flap 42 and is adhered thereto at the overlapping portion.

The bottom edges 134*a*, 136*a* of the end flap 42 and the bottom edges 134*b*, 136*b* of the end flap 62 generally align with the contour of the retaining pattern 130 in the bottom end flap 72. The aligned contours of the end flaps 42, 62 and the bottom retaining pattern 130 define a locking aperture 138 in the first end panel 150. The locking aperture 138 is sized and shaped to receive the locking projection 142, as discussed in further detail below.

An exemplary method of opening the first end of the carton 190 and placing the carton in a dispensing configuration will now be discussed below with reference to FIGS. 6-9.

Figure 6:
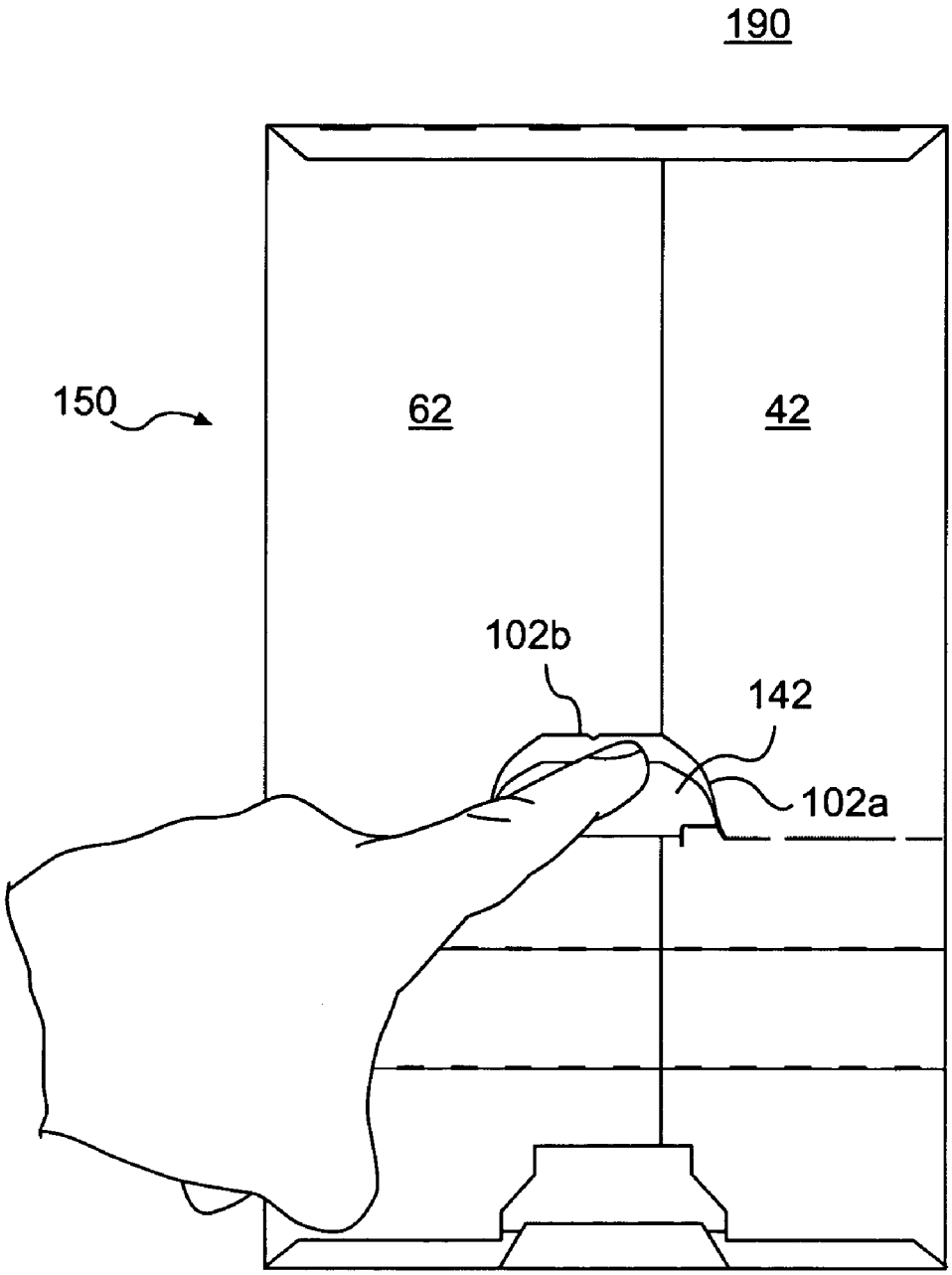
FIGS. 6-8 illustrate opening of the carton.
Figure 7:
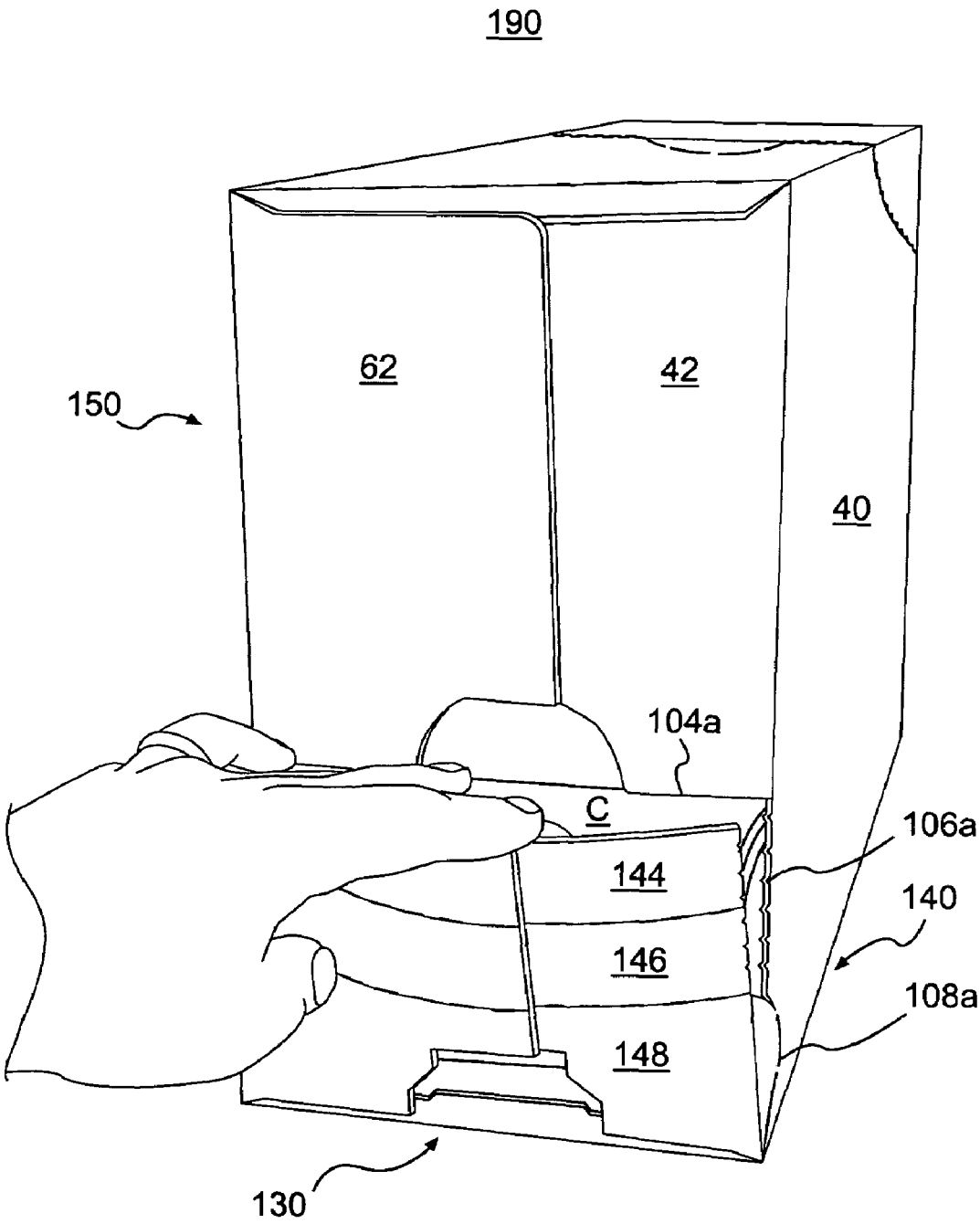

Referring to FIG. 6, the first end panel 150 is breached at the locking projection 142 by tearing the panel at the tear lines 102*a*, 102*b*. Referring to FIG. 7, by pulling outwardly on the retaining structure 140, the carton 190 is torn along the tear lines 104*a*, 106*a*, 108*a* on one side of the carton and along the tear lines 104*b*, 106*b*, 108*b* (not shown in FIG. 7) on the opposite side.

Figure 8:
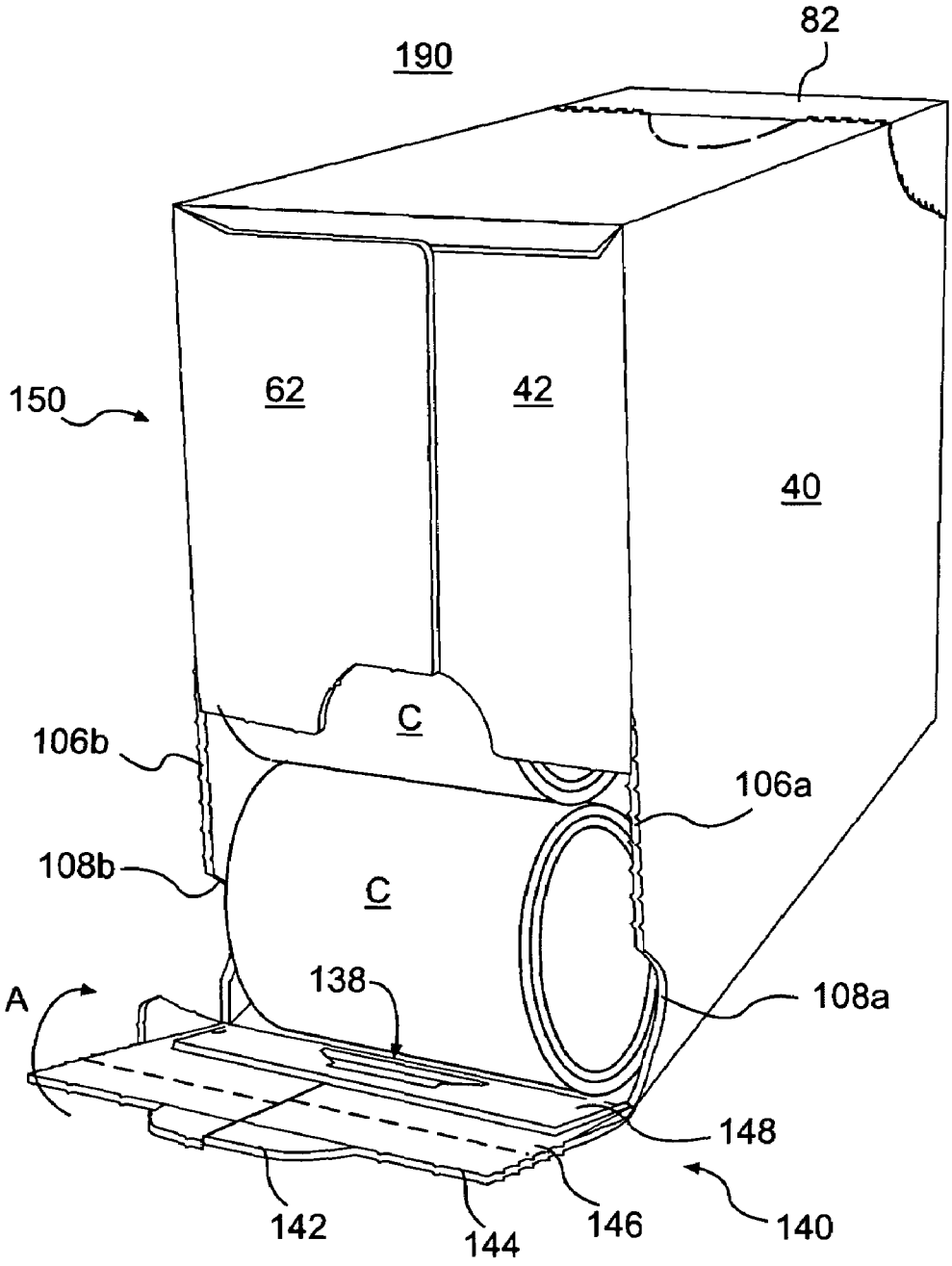

FIG. 8 illustrates the carton 190 with the partially separated retaining structure 140 pivoted away from the remainder of the carton 190. The retaining structure 140 is placed into its retaining configuration by folding the inner stop panel 144, the outer stop panel 146 and the locking projection 142 back toward the bottom stop panel 148 in the direction of the arrow A, and pressing the locking projection 142 into the locking aperture 138. If the bottom retaining pattern 130 defines a cutout that is wholly or partially separated from the carton to create the locking aperture 138, the cutout may be removed before or during insertion of the locking projection 142 into the aperture.

Figure 9:
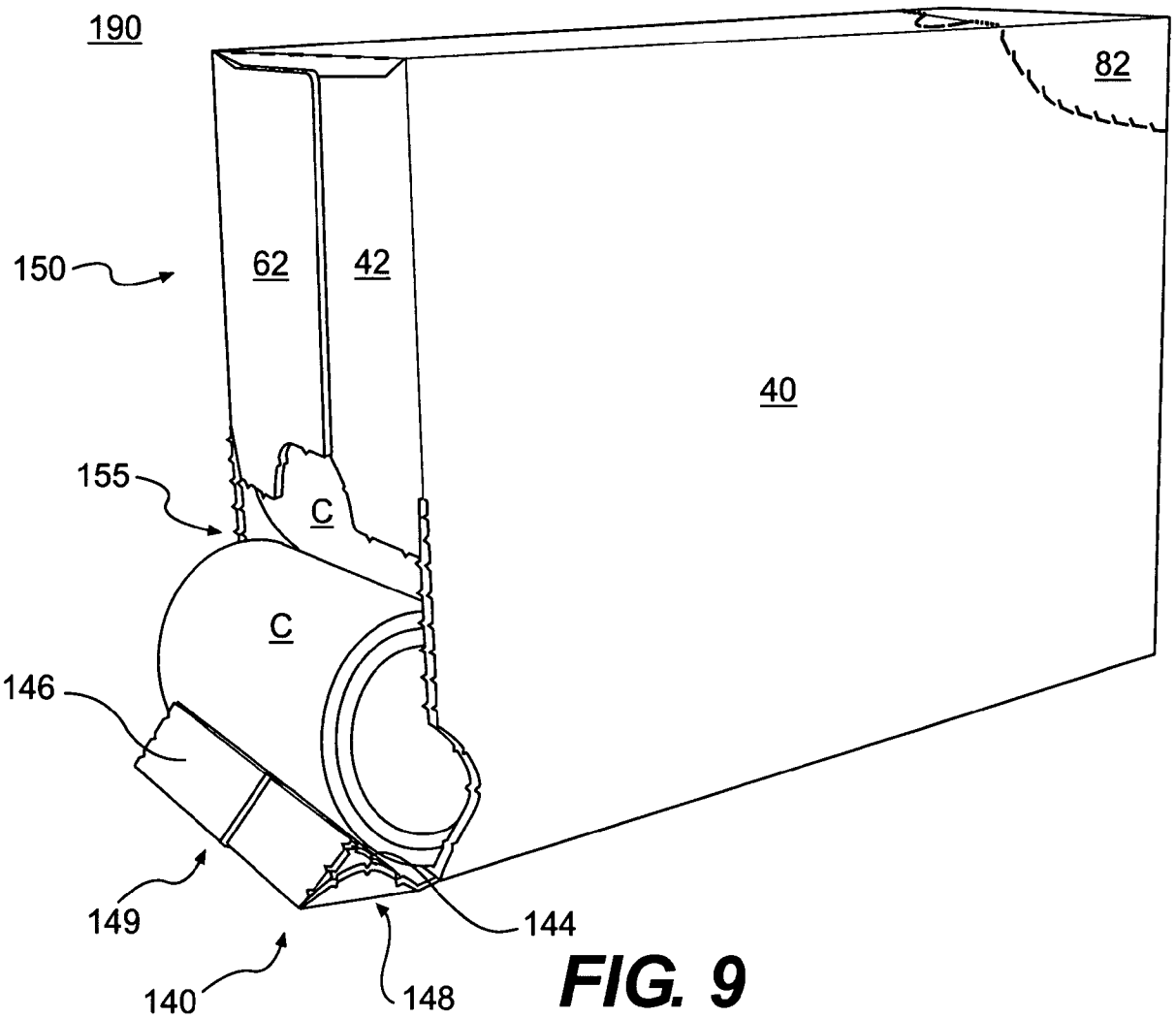
FIG. 9 illustrates the carton in a dispensing configuration with the retaining structure in a retaining configuration.

FIG. 9 illustrates the retaining structure 140 in its retaining configuration, with the locking projection 142 engaged with and extending through the locking aperture 138. The carton 190 is now in a dispensing configuration, where a dispenser opening 155 is left at the first end of the carton 190 through which the containers C can be pulled from the carton 190. The folded panels 144, 146, 148 form a generally triangular-shaped obstruction 149 which a container C disposed at the dispenser opening 155 abuts. The retaining structure 140 therefore restrains the containers C from inadvertently rolling out through the dispenser opening 155 due to the force of gravity. A container C may be pulled past the retaining structure 140 by lifting up on the container and pulling the container away from the dispenser opening 155 and over the obstruction 149. Because the obstruction 149 is spaced a small distance from the first panel 150, significant portions of the side ends of container C at the dispenser opening 155 extend outward past the first end panel 150 and are accessible to grasp during dispensing.

Figure 10:
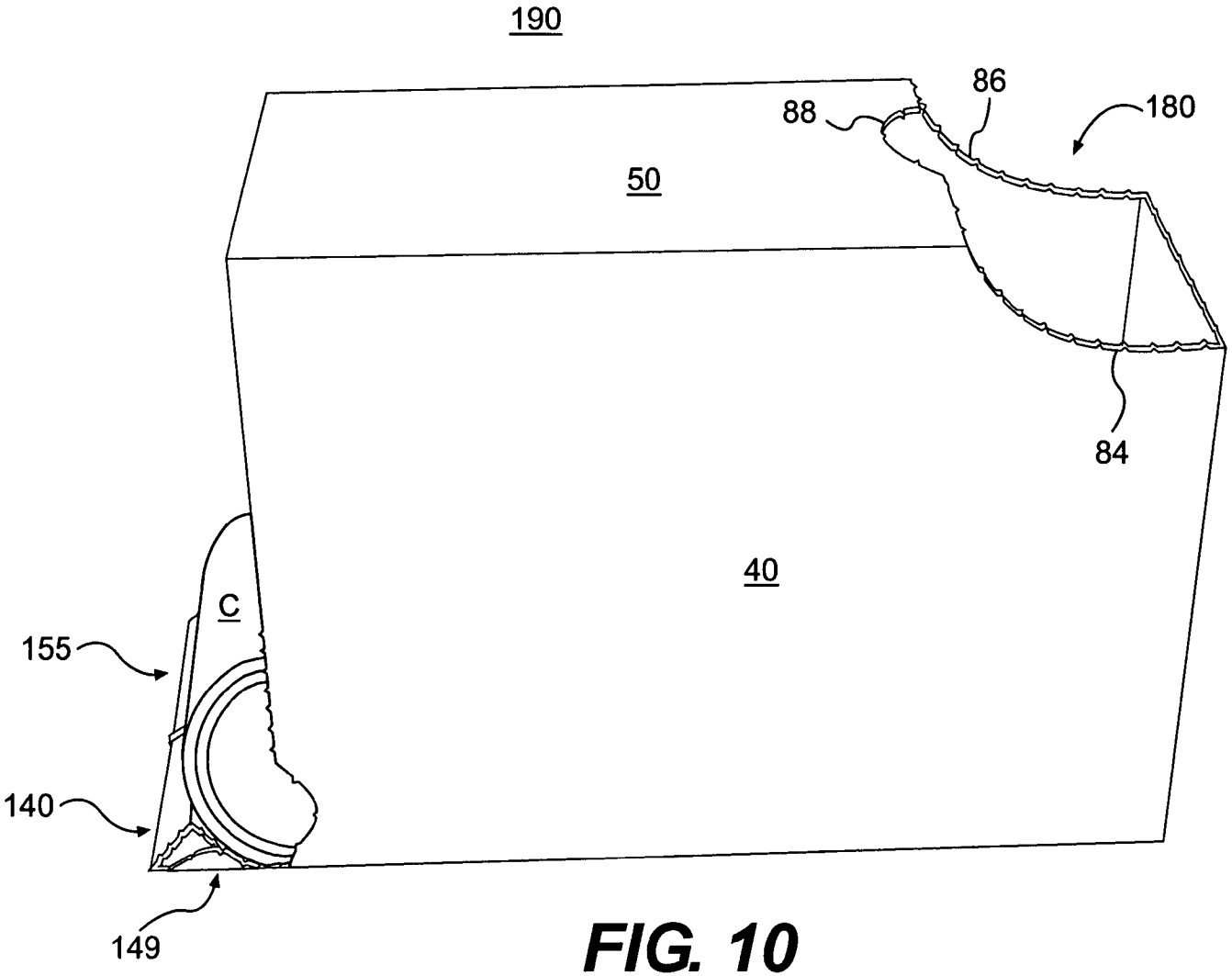
FIG. 10 illustrates the carton with both the first and second ends open.

FIG. 10 illustrates the carton 190 opened at the second end of the carton. The dispenser panel 82 can be removed by tearing the carton 190 along the dispenser pattern 80 (illustrated in FIG. 1). A second dispenser opening 180 is left when the panel 82 is removed. Containers C can be withdrawn from the carton 190 through the dispenser opening 180, or, if necessary, a user can insert his hand into the dispenser opening 180 and advance containers toward the dispenser opening 155 when there are only a few containers remaining in the carton 190.

According to the above embodiment, containers C may be fed to the dispenser opening 155 by the action of gravity. The containers are securely retained at the dispenser opening of the carton by the retaining obstruction 149, and are not likely to fully escape from the carton due to movement of the carton or shifting of the carton contents. The retaining structure 140 may be formed from the first end and side panels of the carton, and therefore does not require additional board area. The retaining obstruction 149 may be spaced from the first end panel 150 so that a container at the dispenser opening 155 may be easily grasped and removed from the carton.

In the above embodiments, the carton is shown as accommodating generally cylindrical metallic containers. Other types of containers, however, can be accommodated within a carton according to the present invention. The dimensions of the blank 8 may also be altered, for example, to accommodate various container forms. In addition, various numbers and arrangements of containers C can be accommodated in a carrier carton according to principles of the present invention, for example, by adjusting the size of the blank 8.

The blank according to the present invention can be, for example, formed from coated paperboard and similar materials such as cardboard, hard paper, or any other material having properties suitable for enabling the carton to function at least generally as described above. The blank can also be laminated to or coated with one or more sheet-like materials at selected panels or panel sections. The interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank.

Fold lines can be any line of disruption that facilitates folding therealong. More specifically, but not for the purpose of narrowing the scope of the present invention, fold lines include: a crease, such as formed by folding; a score line, such as formed with a blunt scoring knife, or the like, which creates a crushed portion in the material along the desired line of weakness; a score that extends partially into the material along the desired line of weakness, and/or a series of spaced apart scores or cuts that extend partially into and/or completely through the material along the desired line of weakness; or various combinations of these features.

A tear line can be any form of weakening intended to facilitate tearing therealong. More specifically, but not for the purpose of narrowing the scope of the present invention, tear lines include: a score that extends partially into the material along the desired line of weakness, and/or a series of spaced apart scores or cuts that extend partially into and/or completely through the material along the desired line of weakness, or various combinations of these features. As a more specific example, one type of tear line is a series of spaced apart cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line.

In the present specification, a "panel" need not be flat or otherwise planar. A "panel" can, for example, comprise a plurality of interconnected generally flat or planar sections.

The above embodiments may be described as having one or more panels adhered together by glue. The term "glue" is intended to encompass all manner of adhesives commonly used to secure paperboard carton panels in place.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A carton, comprising:

a first side panel;

a top panel;

a second side panel;

a bottom panel;

a first end panel at a first end of the carton;

a second end panel at a second end of the carton; and a retaining structure defined at least in the first end panel by a plurality of lines of disruption in the carton, the plurality of lines of disruption comprising a plurality of tear lines defining at least a part of a perimeter of the retaining structure, and the retaining structure comprising:

a plurality of foldable stop panels defined in the first end panel;

a locking projection defined at an upper portion of the retaining structure in the first end panel, above the plurality of foldable stop panels; and a locking aperture defined at a lower portion of the first end panel, wherein the retaining structure is partially separable from a remainder of the carton and the plurality of stop panels are foldable such that the locking projection can be inserted in the locking aperture.

2. The carton of claim 1, wherein the plurality of stop panels comprises at least two foldably connected stop panels disposed in the first end panel between the locking projection and the locking aperture.

3. The carton of claim 1, wherein the plurality of stop panels comprises;

a first panel;

a second stop panel defined below the first stop panel and foldably connected to the first stop panel; and a third stop panel defined below the second stop panel adjacent to the locking aperture and foldably connected to the second stop panel, wherein the first stop panel, the second stop panel and the third stop panel are foldable to respectively form an inner stop panel, an outer stop panel and a bottom stop panel.

4. The carton of claim 1, wherein the carton has a parallelepipedal shape.

5. The carton of claim 1, further comprising a removable dispenser panel defined by a plurality of lines of disruption at the second end of the carton.

6. The carton of claim 1, wherein the first end panel comprises a plurality of end flaps.

7. A method of placing a carton in a dispensing configuration, comprising:

providing a carton according to claim 1;

tearing the carton along the plurality of tear lines, wherein the retaining structure is torn away from part of the carton and a dispenser opening is left at the first end of the carton;

folding the retaining structure; and engaging the locking projection with the locking aperture.

8. A carton in a dispensing configuration and a plurality of articles disposed in the carton, comprising:

a first side panel;

a top panel;

a second side panel;

a bottom panel;

a first end panel at a first end of the carton;

a second end panel at a second end of the carton; and a retaining structure comprising a retaining obstruction, the retaining obstruction being spaced from the first end of the carton and comprising a plurality of foldable stop panels that are respectively folded with respect to one another, a locking aperture positioned at a bottom portion of the retaining structure, and a locking projection connected to the stop panels and engaged with the locking aperture, wherein a dispenser opening is defined in the carton at least in the first end panel, and wherein the articles can be withdrawn from the carton through the dispenser opening, at least one of the articles being in a dispensing position at the dispenser opening and abutting the retaining obstruction.

9. The carton and plurality of articles of claim 8, wherein the article in the dispensing postion extends through the dispenser opening.

10. The carton and plurality of articles of claim 9, wherein the plurality of foldable stop panels comprises:

an outer stop panel;

an inner stop panel connected to the outer stop panel; and a bottom stop panel connected to the outer stop panel and a remainder of the carton, the bottom stop panel extending to the dispenser opening.

11. The carton and plurality of articles of claim 9,wherein the article in the dispensing position abuts at least one of the stop panels.

12. The carton and plurality of articles of claim 10, further comprising a dispenser opening at the second end of the carton.

13. The carton and plurality of articles of claim 10, wherein the carton has a parallelepipedal shape and the first end panel comprises a plurality of end flaps.

14. A method of placing a carton in a dispensing configuration, comprising:

providing a carton having a first end and a second end, a retaining structure being defined at least in the first end;

providing a plurality of articles in the carton;

separating a part of the retaining structure from a remainder of the carton, wherein a dispenser opening is defined in the first end of the carton;

deforming a distal portion of the retaining structure to form a retaining obstruction; and engaging a locking projection of the distal portion with a locking aperture in a bottom portion of the retaining structure.

15. The method of claim 14, wherein one of the plurality of containers is located at the dispenser opening in a dispensing position and abutting the retaining obstruction.

16. The method of claim 15, wherein the article in the dispensing position extends through the dispenser opening.

17. The method of claim 16, wherein deforming a distal portion of the retaining structure comprises folding the retaining structure at a fold line between at least two stop panels of the retaining structure.

18. The method of claim 14, wherein engagin a locking projection with a locking aperture comprises removing a knockout sections.

19. A carton black, comprising:

a first side panel;

a top panel a second side panel;

at least one bottom panel;

a first side end panel foldably connected to the first side panel and comprisinga first retaining pattern, the first retaining pattern defining a first plurality of foldably connected stop panel sections in the first side end panel, and a first locking projection section in the first side end panel:

a second side end panel foldably connected to the second side panel and comprising a second retaining pattern, the second retaining pattern defining a second plurality of folaably connected stop panel sections in the second side end panel, and a second locking projection section in the second side end panel; and a first bottom end panel connected to the at least one bottom panel and comprising a bottom retaining pattern for defining a retaining aperture, wherein the first and second side end panels and the bottom end panel are combinable to form a retaining structure comprising a plurality of stop panels formed by the first and second pluralities of stop panel sections, and a locking projection formed by the first and second locking projection sections, the locking projection being connected to the plurality of stop panel sections at a top portion of the retaining structure, and the plurality of stop panels are foldable to engage the locking projection with the retaining aperture.

20. The carton blank of claim 19, wherein the first retaining pattern comprises a first plurality of fold lines and the second retaining pattern comprises a second plurality of fold lines.

21. The carton blank of claim 20, wherein the first retaining pattern further comprises at least one first tear line and the second retaining pattern further comprises at least one second tear line.

22. The carton blank of claim 21, wherein:

the first plurality of stop panel sections comprises a first inner stop panel section and a first outer stop panel section; and the second plurality of stop panel sections comprises a a second inner stop panel section, and a second outer stop panel section.

23. The carton blank of claim 19, further comprising a plurality of second end flaps extending along a second marginal area of the carton blank.

* * * * *